US005152467A

United States Patent [19]

Hwang

[11] Patent Number: 5,152,467

[45] Date of Patent: Oct. 6, 1992

[54] MACHINE FOR REDUCING THE VOLUME OF A BUNDLE OF RUBBISH

[76] Inventor: Ching-Long Hwang, No. 6, Fu-Hsing Rd., Tu-Ku Chen, Yunlin Hsien, Taiwan

[21] Appl. No.: 754,596

[22] Filed: Sep. 4, 1991

[51] Int. Cl.[5] ..... B02C 23/00

[52] U.S. Cl. ..... 241/41; 241/60; 241/152.2; 241/DIG. 38

[58] Field of Search ..... 241/92, 152 A, DIG. 38, 241/60, 41, 20, 152.2

[56] References Cited

U.S. PATENT DOCUMENTS 3,713,594 1/1973 Blakley et al. ..... 241/DIG. 38 X
3,741,863 6/1973 Brooks ..... 241/DIG. 38 X
4,732,606 3/1988 Köbele et al. ..... 241/20 X
4,940,187 7/1990 Lee ..... 241/DIG. 38 X

FOREIGN PATENT DOCUMENTS 3185498 8/1988 Japan ..... 241/DIG. 38
3256174 10/1988 Japan ..... 241/DIG. 38

*Primary Examiner*—Mark Rosenbaum
*Assistant Examiner*—Frances Chin
*Attorney, Agent, or Firm*—Bacon & Thomas

[57] ABSTRACT

A machine to reduce the volume of a bundle of rubbish includes a pair of crushing rollers, a grinding plate, a container to enclose the grinding plate and a water tank to supply water into the crushing rollers and the grinding plate, a driving shaft connected to the grinding plate and a device for rotating the driving shaft and the crushing rollers.

4 Claims, 3 Drawing Sheets

MACHINE FOR REDUCING THE VOLUME OF A BUNDLE OF RUBBISH

BACKGROUND OF THE INVENTION

1. Field of Invention

The present invention relates to a machine, more particularly to a machine which can reduce a volume of a bundle of rubbish that is fed therethrough.

2. Description of the Related Art

As available land continues to become more scarce in modern countries, the burying of rubbish has come to be considered an unwise method of garbage disposal. Burying rubbish neither present pollution nor allows the recycling of precious resources, some of which (like timber) take years to produce. Similarly, the burning of rubbish negates the possibility of recycling. The burying of garbage does not prevent pollution in all cases, for instance, burying certain materials have sometimes contaminated the local water supplies.

The capacity to compress garbage is therefore increasingly vital. Although modern technology has provided in the past various compressing methods, none of them have managed to reduce the volume of any given bundle of garbage to a satisfactory level.

SUMMARY OF THE INVENTION

Therefore it is a main object of the present invention to provide a machine which is free of the above-mentioned drawbacks and at the same time can reduce the volume of a bundle of rubbish to a satisfactory level.

Accordingly, a machine of the present invention includes a compressing means and a grinding means and a cooling means to reduce the heat caused by the compressing means and the grinding means so that a bundle of rubbish fed into said machine is reduced to a very small size.

BRIEF DESCRIPTION OF THE DRAWINGS

This and other features and advantages of the present invention will become more obvious in the following detailed description, including drawings, all of which show a non-limiting form of the invention, and of which.

DETAILED DESCRIPTION OF THE PREFERRED EMBODIMENT

Figure 1:
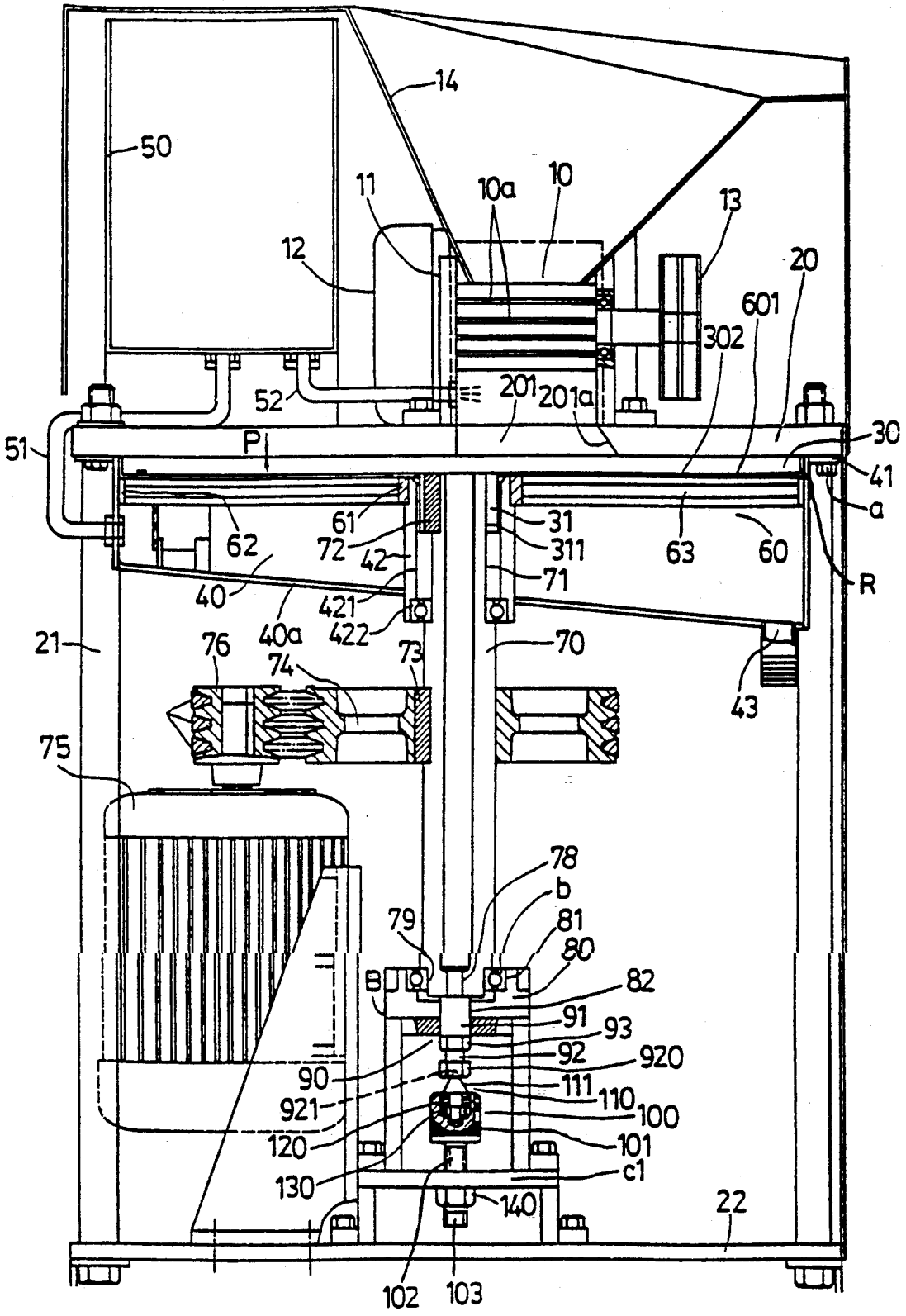
FIG. 1 shows a perspective, schematic view of a machine of the present invention.
Figure 2:
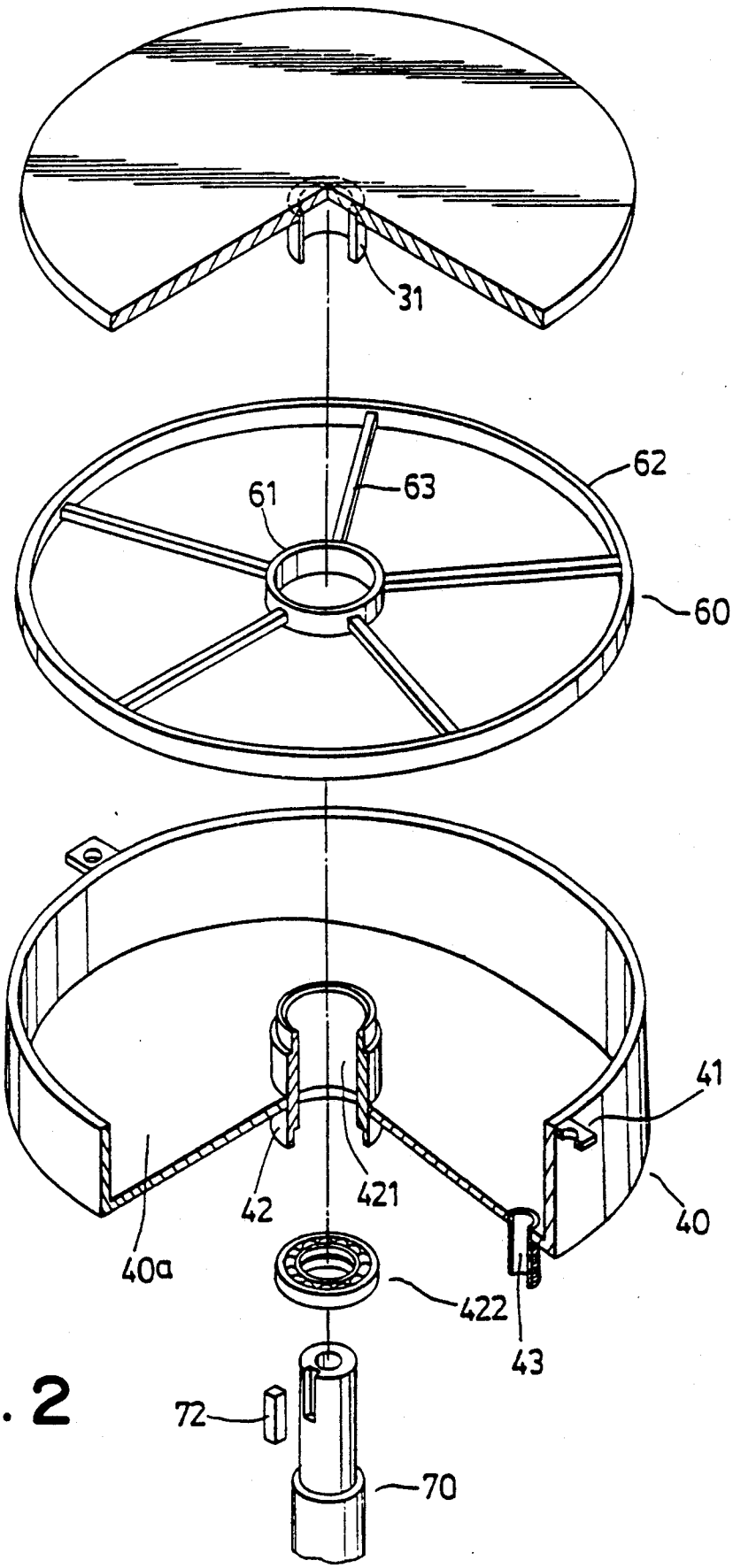
FIG. 2 shows a fractional exploded view of the preferred embodiment of the present invention.
Figure 3:
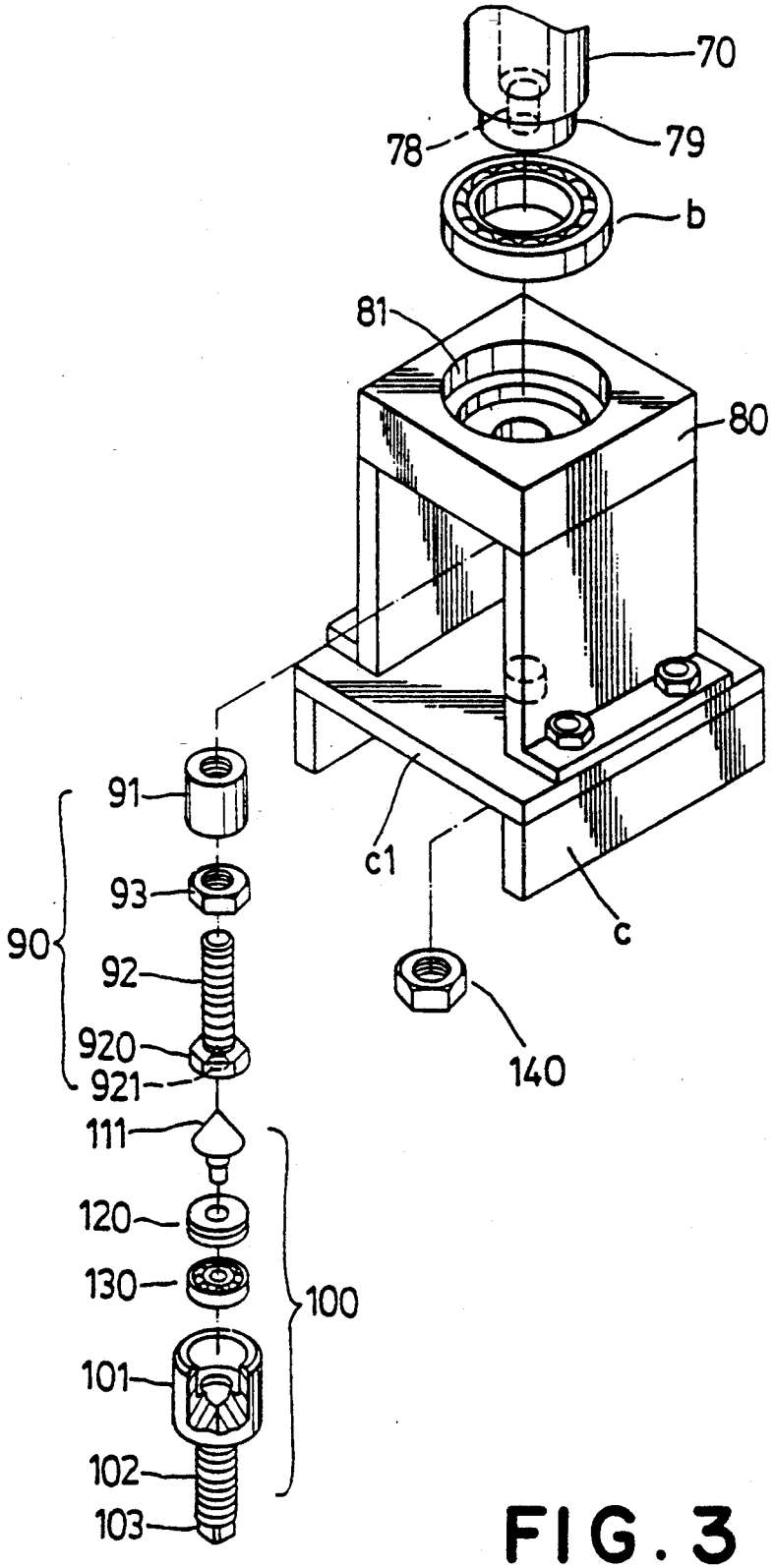
FIG. 3 shows a perspective view of a fractional exploded view of the preferred embodiment of the present invention.

As illustrated in the Figures, a machine for reducing a volume of a bundle of rubbish includes a pair of crushing or compressing rollers 10, a circular plate 30, a container 40, a reinforcing member 60, a support frame 21, a base support 80 and a screw adjustable member 90.

The support frame 21 has a top support plate 20 and a bottom support plate 22. A rectangular casing 11 is mounted on the center of the top support plate 20 in which the pair of rollers 10 is mounted. Each of the rollers has a toothed surface 10*a* for gnawing an incoming object. A feeding mouth 14 is provided at the top end of the casing 11 for feeding rubbish to pass through the toothed surfaces 10*a* of the rollers 10.

A first driving means 12 is fixed on the top supporting plate 20 for driving the pair of rollers 10 by a belt.

The circular plate 30 is disposed in the support frame 21 underneath the top support plate 20 in such a manner that a clearance P is formed between the bottom of the top support plate 20 and the top surface of the circular plate 30. The casing 11 has an opening 201 eccentrically located on the top support plate 20 with an inclined side 201*a* away from the center point of the top support plate so that gnawed objects from the casing 11 can pass into the clearance through said opening 201. The provision of the inclined side 201*a* makes it easier for the gnawed objects to be passed into the opening 201 of the top support plate 20.

A container 40 having a closed bottom and a top open end with a plurality of lugs 41 extending radially and outwardly from the periphery of the top open end by which to attach the bottom side of the circular plate 30. Thus the circular plate 30 is enclosed within the container 40, covering off the top open end of the container 40. The container 40 has a sleeve member 42 extending upward from the center of the bottom of the container 40 and includes an opening 421 therethrough. The bottom of the container 40 is inclined with an outlet 43 formed at a lowermost portion of the same.

The circular plate 30 has a tubular member 31 extending downward, into the opening 421 of the sleeve member 42 and a bearing 422 is provided between the tubular member 31 and the sleeve member 42.

The circular plate 30 has a smaller diameter than the diameter of container 40, as seen in FIG. 1. The downwardly extending tubular member 31 of the circular plate 31 is received within the sleeve member 42 which extends centrally upwardly through the container 14. This serves to retain circular plate 30 at the top end of the container 40 to form a second clearance R between the periphery of circular plate 30 and the inner wall of container 40. Circular plate 30 serves as a cover for container 40. The second clearance R serves as an inlet to container 40, with outlet 43 being formed at the bottom of container 40.

A reinforcing member 60 includes an inner ring 61 sleeved rigidly on a shoulder formed on a portion of the sleeve member 42, while an outer ring 62 is provided inside the container 40 abutting against the inner wall of the same. A plurality of ribs 63 extend from the inner ring 61 to the outer ring 62 for the purpose of strengthening the rigidity of the container 40.

A water tank 50 is provided on the top support plate 20 of the support frame 21, from which a first pipe 51 extends into the container 40 and a second pipe 52 extends into the rectangular casing 11. Their purpose is to supply water for reducing the heat from the continuous gnawing and grinding of the pair of rollers 10 and the circular plate 30.

A hollow driving shaft 70 has a neck portion 71 adjacent to one end thereof, and passing through the sleeve member 42 of the container 40 and inserted into the tubular member 31 of the circular plate 30 and joined both together by a pin key 72. A driving roller 74 is mounted on an intermediate portion of the driving shaft 70 and held fixed thereon by another pin key 73. The other end of the driving shaft also has a projection 78 with a neck portion 79, the latter being sleeved by a bearing B and journalled on a support base 80. The support base 80 is mounted on a cushioning plate C1 which is again fixed on the bottom support plate 22 of the support frame 21.

A screw adjustable member 90 includes a sleeve member 91 inserted through the support base 80, a threaded bolt 92 with nut 93 threaded thereon passes through the sleeve member 91 to connect with the internal thread of the projection 78 of the hollow driving shaft 70.

An adjustable shaft 100 includes a threaded shaft 102 with a bearing receiving space 101 at one end thereof and a threaded nut 140. The other end of the threaded shaft 102 passes through the cushioning plate C1 and connects thereto by the threaded nut 140. The head 920 of the bolt 92 has a tapered recess 921 to receive a tip end of a transmission member 111, and the other end of the transmission member 111 is inserted in a bearing 120 received on a plate 130 in the bearing receiving space 101 of the threaded shaft 102. The clearance P between the top support plate 20 and the circular plate 30 can be adjusted by tightening or loosening the nut 140. For this purpose, the head of the shaft 102 is made to be a hexagonal shape in order to be clamped by a spanner.

A belt 76 is wound around the driving roller 74 and connected to a motor 75 for rotating the same. The motor 75 is mounted on the bottom of the support frame 21.

The above is the construction of the machine of the present invention. From its construction, it is obvious to those skilled in the art that rubbish of a selected type can be fed into the machine and reduced to a volume of small size. It is important to observe that recycling materials are separately fed and collected individually.

The rubbish is first graded accorded to quality before it is fed into crushing rollers 10. The graded rubbish, after being compressed and gnawed by crushing rollers 10, exit rollers 10 as rubbish lumps which are smaller in size than those fed into rollers 10. These rubbish lumps are small enough to enter into the clearance P formed between top support plate 20 and circular plate 30 through opening 201 formed in plate 20. Since plate 20 remains stationary, rotation of circular plate 30 by shaft 70 results in grinding of the rubbish lumps between plates 20 and 30. During this grinding process, the rubbish lumps turn into a powder state which changes into a slurry when mixed with water from water tank 50 fed through second pipe 52. The slurry of rubbish falls into container 40 through the second clearance formed between the periphery of circular plate 30 and the inner wall of container 40.

With the invention thus explained, it is obvious to those skilled in the art that various modifications and variations can be made without departing from the scope and spirit of the present invention. It is therefore intended that claims be treated only as in the appended claims.

I claim:

1. A machine for reducing the volume of a bundle of rubbish comprising:

a) a support frame including a bottom support plate and a top support plate spaced from the bottom support plate, the top support plate including a top side and a bottom side;

b) a rectangular casing positioned centrally on the top support plate, a pair of compressing rollers disposed within the casing, the casing having a feeding mouth at a top end thereof through which rubbish may be fed to pass between the pair of compressing rollers;

c) a first driving means provided on the top support plate for driving the pair of compressing rollers;

d) a circular plate disposed within the support frame under the top support plate, the circular plate having a top side and a bottom side, a first clearance being formed between the bottom side of the top support plate and the top side of the circular plate, the circular plate having a tubular member extending downwardly from the center of the bottom side thereof;

e) a container defining a cylindrical receiving space therein and having a plurality of lugs extending outwardly from a periphery of a top open end thereof, the container being attached to the bottom side of the top support plate to enclose the circular plate within the container, the circular plate having a smaller diameter than the diameter of the container to form a second clearance between the periphery of the circular plate and an inner wall of the container, the casing having an eccentric opening formed therethrough to provide communication between the casing and the first clearance and through which opening compressed rubbish passes into the first clearance;

f) the container having a sleeve member extending upwardly from the center of its bottom, the tubular member of the circular plate extending into the sleeve member of the container, with the sleeve member abutting against the bottom side of the circular plate wherein the circular plate substantially covers the open top end of the container, and an outlet formed in the bottom of the container;

g) a bearing means provided between the tubular member of the circular plate and the sleeve member of the container;

h) a water tank provided on the top support plate and having a first pipe extending into the container, and a second pipe extending into the rectangular casing;

i) a hollow driving shaft provided with a first end having an internal thread, a cushioning plate mounted on the bottom support plate of the support frame, a bearing seat mounted on the cushioning plate, the first end of the driving shaft being journalled on the bearing seat, and a second end of the driving shaft extending through the container and connected to the tubular member of the circular plate;

j) means for permitting the circular plate to rotate with the driving shaft; and k) a second driving means for rotating the driving shaft and circular plate.

2. A machine as claimed in claim 1, wherein said machine further comprises an inner ring rigidly sleeved around a neck portion formed on said sleeve member of said container and an outer ring provided therein abutting against the inner wall of said container, and a plurality of ribs connecting said inner ring to said outer ring for strengthening the rigidity of said container.

3. A machine as claimed in claim 1, wherein the bottom of said container is inclined, said outlet is formed at the lowermost portion of said inclined bottom.

4. A machine as claimed in claim 1, wherein said machine further includes an adjustable screw member and an adjustable shaft supporting said adjustable screw member for varying the height of said hollow driving shaft, said adjustable screw member includes a second sleeve member inserted through said support base, and a threaded bolt with a first threaded nut thereon passes said second sleeve member to connect said internal thread of said first end of said hollow driving shaft, said threaded bolt having an enlarged head with a recessed groove formed thereon, said adjustable shaft includes a threaded shaft with a bearing receiving space at one end thereof, a second threaded nut and a transmission member, another end of said threaded shaft passes through said cushioning support and connect thereto by said second threaded nut, said transmission member having a tapered first end being received in said recessed groove of said threaded bolt and a second end being received in said bearing receiving space.

* * * * *